US006719585B2

(12) United States Patent
Egbert

(10) Patent No.: US 6,719,585 B2
(45) Date of Patent: Apr. 13, 2004

(54) DSX CABLE CONNECTION SYSTEM

(75) Inventor: Benjamin Egbert, Spokane, WA (US)

(73) Assignee: Telect, Inc., Liberty Lake, WA (US)

( * ) Notice: Subject to any disclaimer, the term of this patent is extended or adjusted under 35 U.S.C. 154(b) by 0 days.

(21) Appl. No.: 10/236,451

(22) Filed: Sep. 6, 2002

(65) Prior Publication Data

US 2004/0048513 A1 Mar. 11, 2004

(51) Int. Cl.[7] ..... H01R 13/40
(52) U.S. Cl. ..... 439/578; 578/584; 578/609
(58) Field of Search ..... 439/578, 584, 439/609, 610, 585

(56) References Cited

U.S. PATENT DOCUMENTS 4,912,428 A * 3/1990 Shen et al. ..... 333/260
4,995,836 A * 2/1991 Toramoto ..... 439/675
5,052,944 A 10/1991 Mitani et al.
5,059,139 A * 10/1991 Spinner ..... 439/583
5,061,827 A 10/1991 Grabbe
5,092,784 A 3/1992 de Mendez et al.
5,098,314 A 3/1992 Castagna et al.
5,123,864 A 6/1992 Karlovich
5,181,861 A 1/1993 Gaver, Jr. et al.
5,467,062 A 11/1995 Burroughs
5,532,659 A 7/1996 Dodart
5,603,636 A 2/1997 Kanou et al.
5,695,357 A 12/1997 Wright
6,083,034 A 7/2000 Kameyama
6,126,453 A 10/2000 Gomez et al.
6,331,123 B1 * 12/2001 Rodrigues ..... 439/584

* cited by examiner

*Primary Examiner*—Truc Nguyen
(74) *Attorney, Agent, or Firm*—Wells St. John P.S.

(57) ABSTRACT

A cable connection system, including an apparatus and a process, for receiving a digital signal cross-connect cable with an exposed center conductor section and an exposed outer conductor section, the cable connection system including a connection system framework, a center conductor electrical contact mounted relative to the framework such that it is disposed to make electrical contact with the center conductor of the cable when the cable is inserted in the cable connection system, an outer conductor contact mounted relative to the framework such that it is disposed to make electrical contact with the outer conductor when the cable is inserted in the cable connection system; and a cable clamp mounted relative to the framework such that it is configured to receive and retain the cable.

21 Claims, 12 Drawing Sheets

170
171
172
173
174
176
177
178
180
181

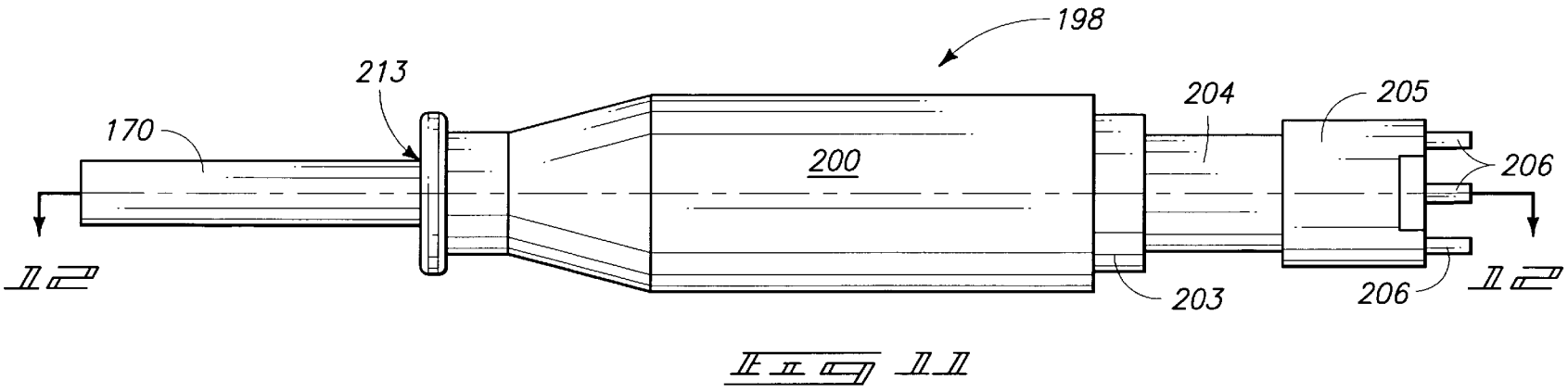
206
205
206
II
204
203
198
200
II
II
213
170
II
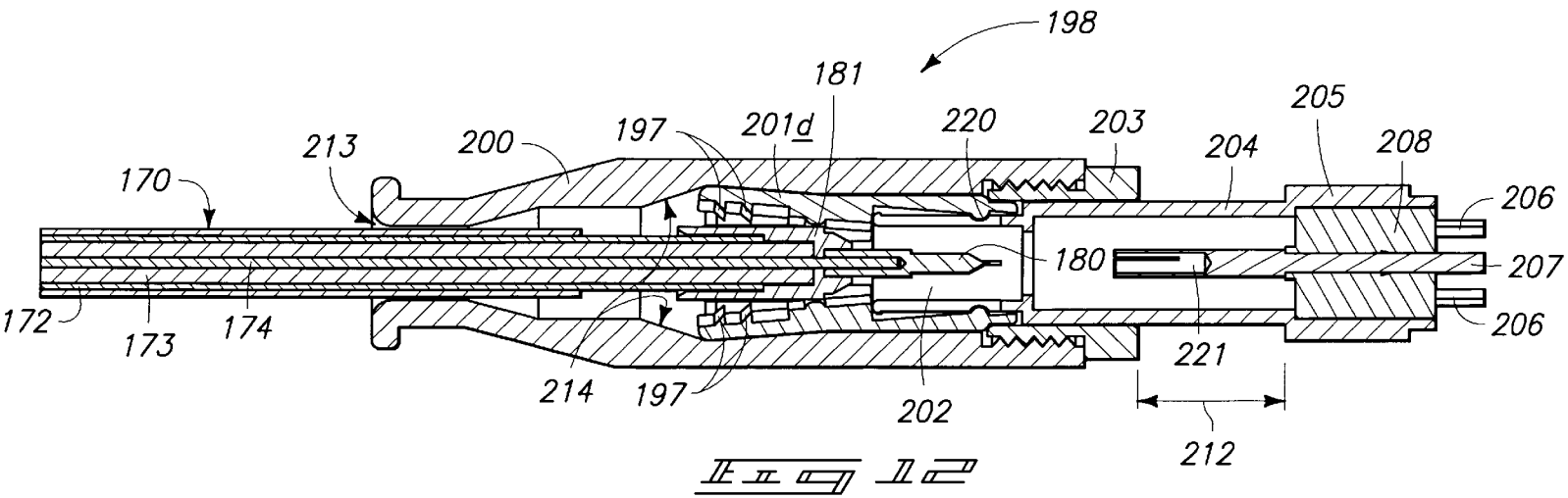
206
207
206
208
205
204
221
212
203
180
198
220
202
II
181
201d
II
197
197
214
200
213
174
170
173
172
II

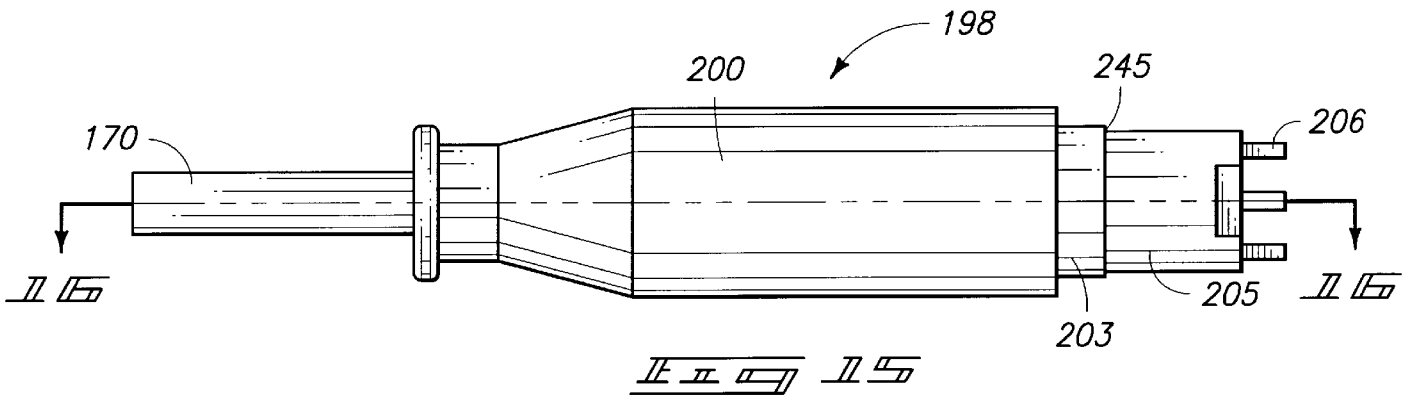
206
205
245
203
198
200
170
II 5
II 5
II 6
II 6
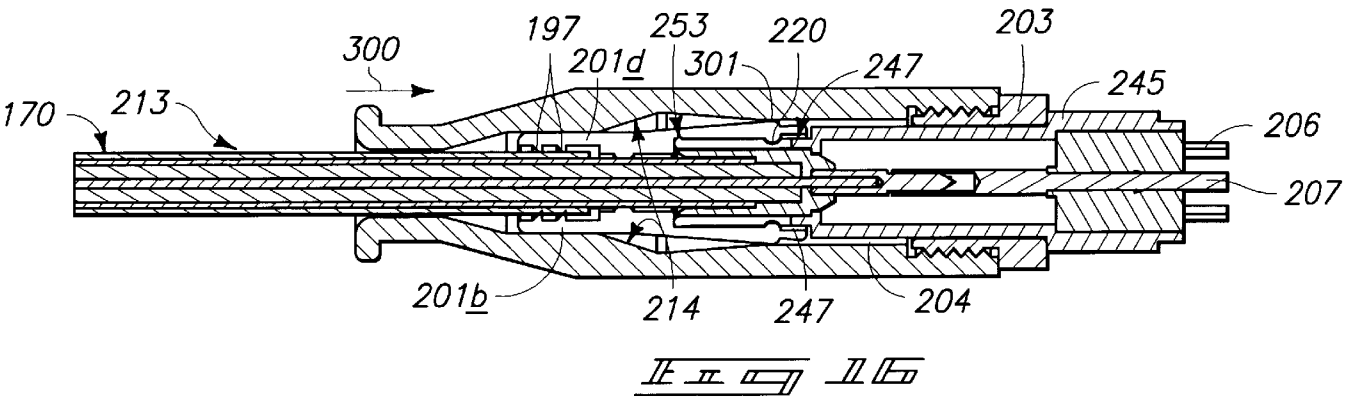
206
207
245
203
204
198
247
220
247
301
253
214
201d
197
201b
300
213
170
II 7
II 7
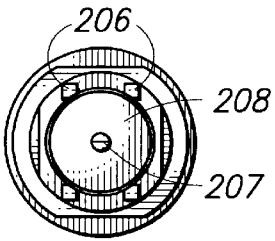
208
207
206
II 8
II 8

DSX CABLE CONNECTION SYSTEM

CROSS REFERENCE TO RELATED APPLICATION

There are no related applications.

TECHNICAL FIELD

This invention generally pertains to a digital cross connect cable connection system for use in the telecommunications industry, including modules, panels and frameworks for use in telecommunications equipment. The digital cross connect or DSX cable connection system applies to individual cables being connected to any type of equipment, as well as to the plurality of connectors, modules or panels utilizing such connections.

BACKGROUND OF THE INVENTION

In the telecommunications industry, cables such as coaxial cables have been utilized for many years. When cables are attached or connected to other equipment, a connector is attached to a terminal end of the cable and utilized to make the connection to a corresponding connector on the equipment or accessory to which the connection is being made.

In a typical cable connection, the cable is stripped and prepared to receive such a connector, which may be a bayonet type of connector, a BNC connector, or any one of a number of other types. Once the connector is clamped or otherwise attached to the cable, a mating connector or recipient is then utilized to make the electrical connection(s).

A substantial amount of time and expense is spent preparing the cable, attaching or installing the connector, and then making the connection.

In the telecommunications industry, there is an ever-increasing need to increase the density for existing equipment and facilities space. In many applications, the additional size or width of the connectors is a limiting factor in increasing the density of connections on a particular panel or in a particular cabinet.

In some embodiments, it is an object to save the labor costs of assembling and attaching a typical connector system, including in the preparation of the cable and installation of the connector on the cable.

It is therefore desirable to provide a cable connection system which has a smaller footprint or smaller size requirement than the typical industry standard BNC connector.

It is therefore an object of this invention to provide an improved cable connection system for use on coaxial cables.

BRIEF DESCRIPTION OF THE DRAWINGS

Preferred embodiments of the invention are described below with reference to the following accompanying drawings.

FIG. 7 is a front elevation view of an exemplary coaxial cable as prepared to be utilized in an embodiment of the cable connection system contemplated by this invention;

FIG. 8 is an elevation view of a coaxial cable which has been prepared for utilization in an embodiment of a cable connector system contemplated by this invention;

FIG. 9 is section 9—9 from FIG. 8 of the coaxial cable;

FIG. 10 is a perspective exploded view of a coaxial cable and an embodiment of a cable connection system contemplated by this invention;

FIG. 14 is section 14—14 from FIG. 13;

FIG. 15 is an elevation view of a coaxial cable fully inserted and locked into an embodiment of a cable connection system contemplated by this invention;

FIG. 16 is section 16—16 from FIG. 15;

FIG. 17 is an end view of the embodiment of a cable connection system contemplated by this invention as shown in FIG. 15;

DETAILED DESCRIPTION OF THE PREFERRED EMBODIMENTS

Figure 1:
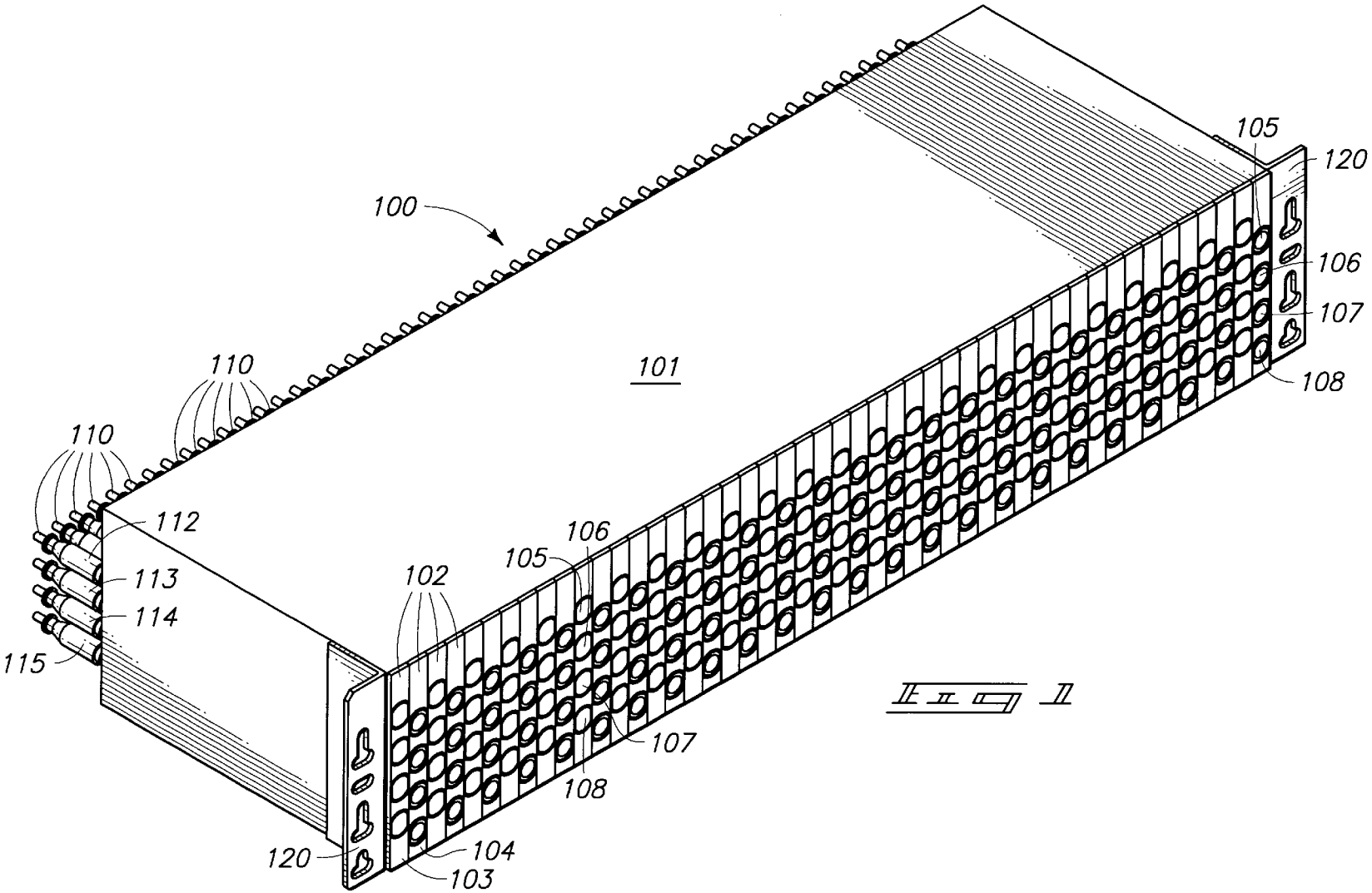
FIG. 1 is a front perspective view of a digital cross connect chassis with 48 DSX-3 modules.

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

The term "telecommunications component" as used in the claims and otherwise herein is intended to mean and refer to any type of telecommunications equipment such as, without limitation, Digital Cross-Connect (DSX) cabinets, connectors, modules, couplers, DSX3 connections utilizing coaxial cable, and others.

The term "connection system framework" as used in the claims and otherwise herein is intended to mean and refer to any framework, structure or body, whether it be in one piece, or in a plurality of pieces or sections, such as is shown in the drawings.

Although certain preferable dimensions are recited herein, there are no particular dimensions required to practice the embodiments of this invention.

FIG. 1 is a front perspective view of a chassis in which the embodiments of this invention may be utilized. FIG. 1 illustrates a chassis system 100 with chassis framework 101, brackets 120 for mounting chassis framework to a distribution frame, a plurality of DSX-3 modules 102 (DSX is an industry-wide acronym for digital cross connects).

FIG. 1 is a high density chassis with odd modules 103 and even modules 104. It can be seen from FIG. 1 that the high density mini-weico connectors are flat on the sides to achieve higher density (this is shown better in later figures). The odd-numbered modules 103 are vertically offset with respect to the even-numbered modules 104 to allow better access to patch cords placed in mini-weico connectors.

FIG. 1 shows a typical module including 4 mini-weico connectors or apertures, including first connector 105, second connector 106, third connector 107 and fourth connector 108. The chassis illustrated in FIG. 1 includes 48 modules for a chassis to be mounted on a 23-inch distribution frame.

On the rear side of chassis framework 101 are cross connect connections for cross connecting various signal lines. FIG. 1 illustrates a plurality of coaxial cables 110 and cable connection systems 111 mounted relative to the rear of the chassis framework. Rear cross connect cable connector 112 corresponds to front connector 105, rear cross connect 113 corresponds to front connector 106, rear cross connect 114 corresponds to front connector 107, and rear cross connect 115 in the lower position corresponds to the patch connector 108 which is correspondingly in the lower position. It will be noted that while the patch connectors on the front end of the chassis framework are staggered or offset with respect to one another in the vertical direction, the cable connectors 111 at the rear end of the chassis framework 101 are horizontally and vertically aligned, although there are no particular configurations required to practice embodiments of this invention.

The cable connectors represented by items 111 through 115 are embodiments of this invention as described more fully below and with respect to later figures. A feature of the cable connectors is the ability to connect coaxial cable for digital signal cross connect directly to a connector without having to prepare and install a corresponding connector on the coaxial cables 110. This allows operators and users of the cross connect functions to preferably minimally prepare the coaxial cable and simply push, force or insert it into the cable connectors 111. Although no particular configuration, orientation or location is required to practice this invention, first connector 105 is a monitor aperture, second connector 106 is a monitor aperture, third connector 107 is an output aperture, and fourth connector 108 is a input aperture, in the embodiment shown in FIG. 1.

Figure 2:
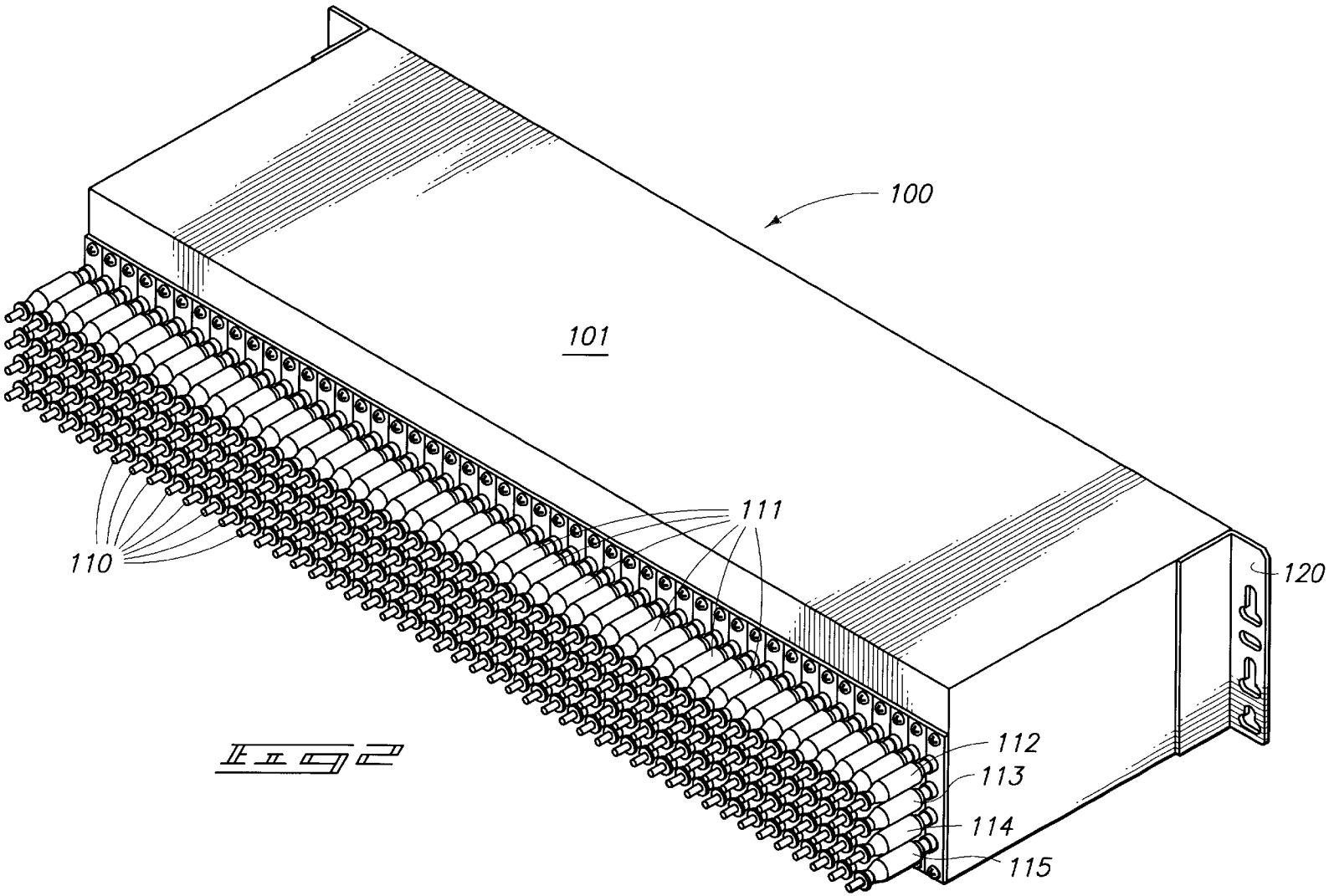
FIG. 2 is a rear perspective view of the DSX-3 chassis shown in FIG. 1 and illustrating the rear cross connects for receiving coaxial cables.

FIG. 2 is a rear perspective view of the chassis framework 101 of the chassis system 100 shown in FIG. 1, illustrating mount brackets 120, cable connectors 111, coaxial cables 110, first cable connector 112, second cable connector 113, third cable connector 114 and fourth cable connector 115 corresponding to a digital cross connect module.

Figure 3:
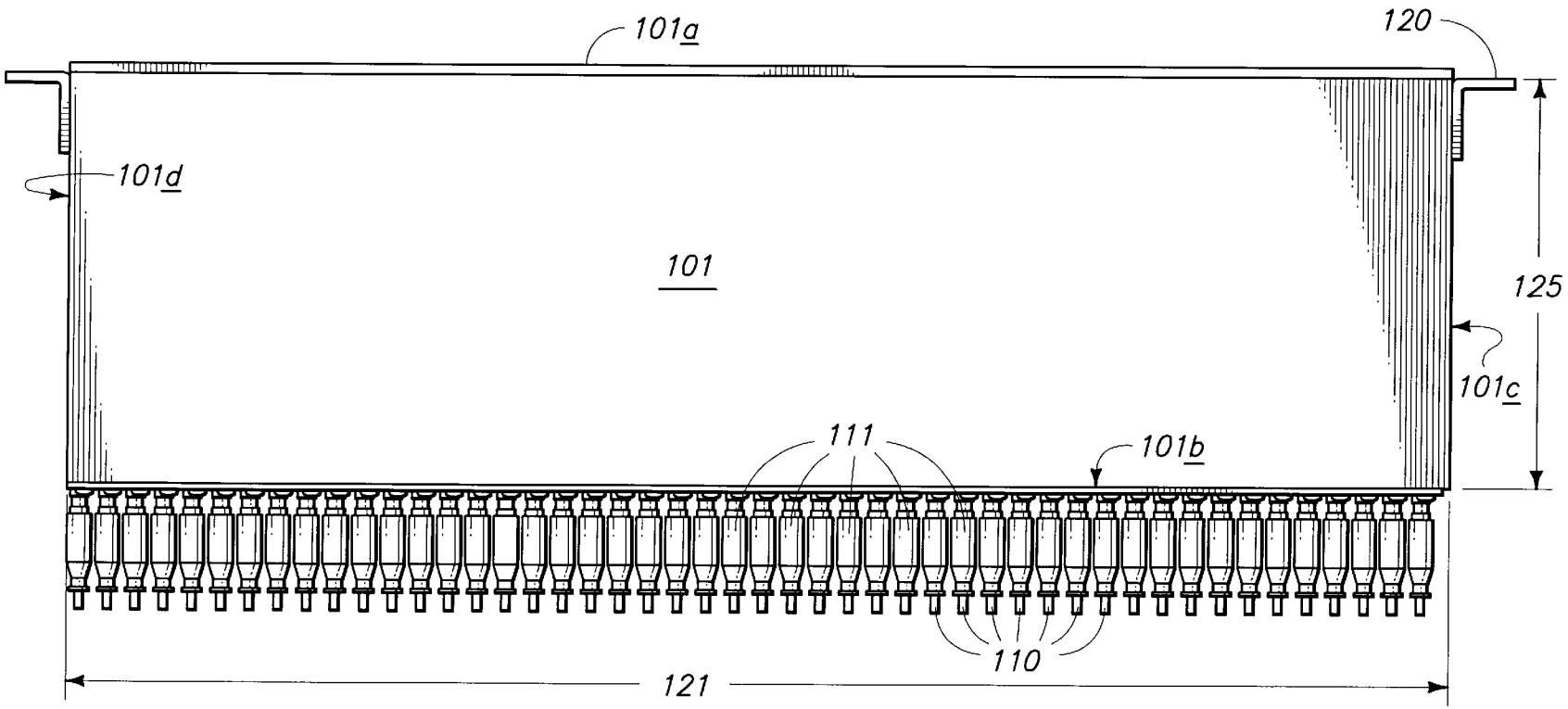
FIG. 3 is a top view of the DSX-3 chassis shown in FIG. 1.

FIG. 3 is a top view of the chassis framework 101 shown in FIGS. 1 and 2 and illustrates front end 101*a*, rear end 101*b*, first side 101*c* and second side 101*d* of chassis framework 101. FIG. 3 shows mount brackets 120, coaxial cables 110 and cable connectors 111. Since there are 48 modules and since this is designed to fit within an industry standard 23-inch distribution frame, the distance 121 will be less than 23 inches, and in this case it is preferably approximately twenty-one and one-fourth inches. The approximate depth of the chassis framework 101 is distance 125, which is preferably approximately six and one-half inches.

Figure 4A:
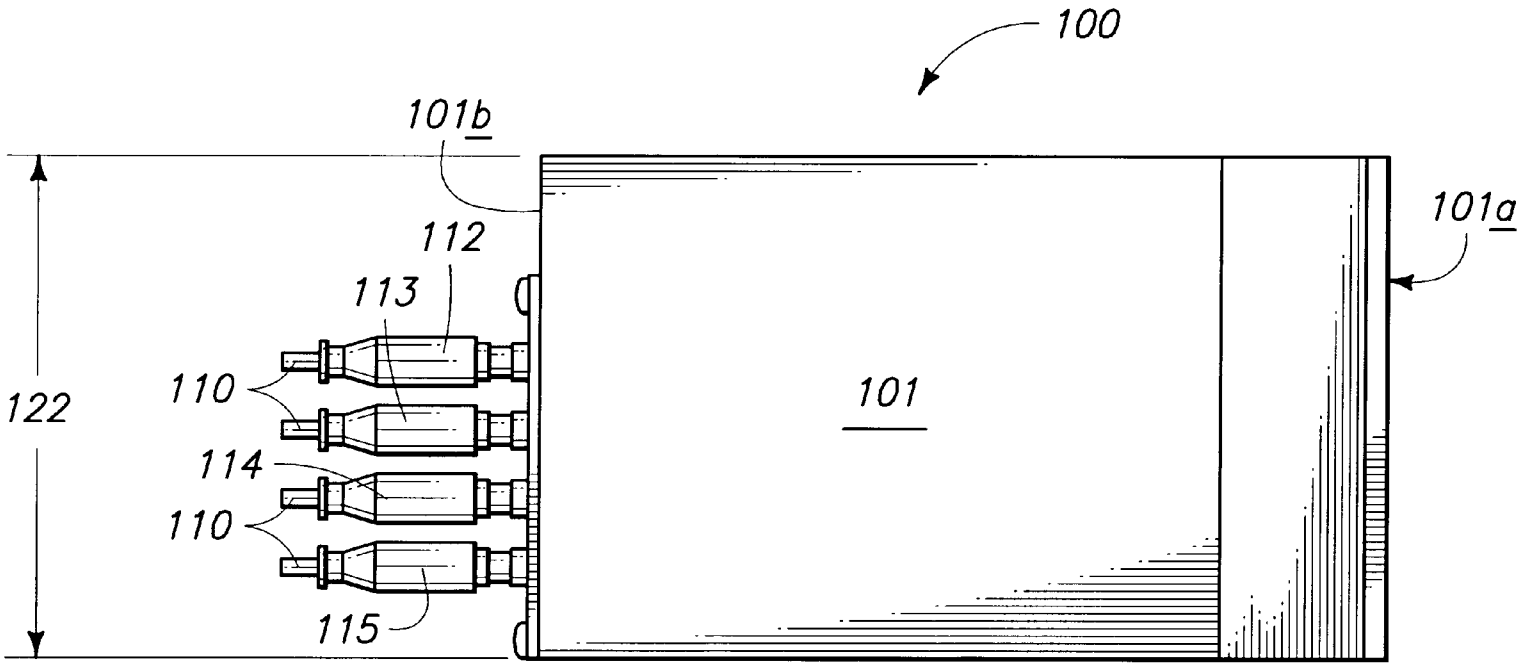
FIG. 4 is a side view of the DSX-3 chassis illustrated in FIG. 1.
Figure 5:
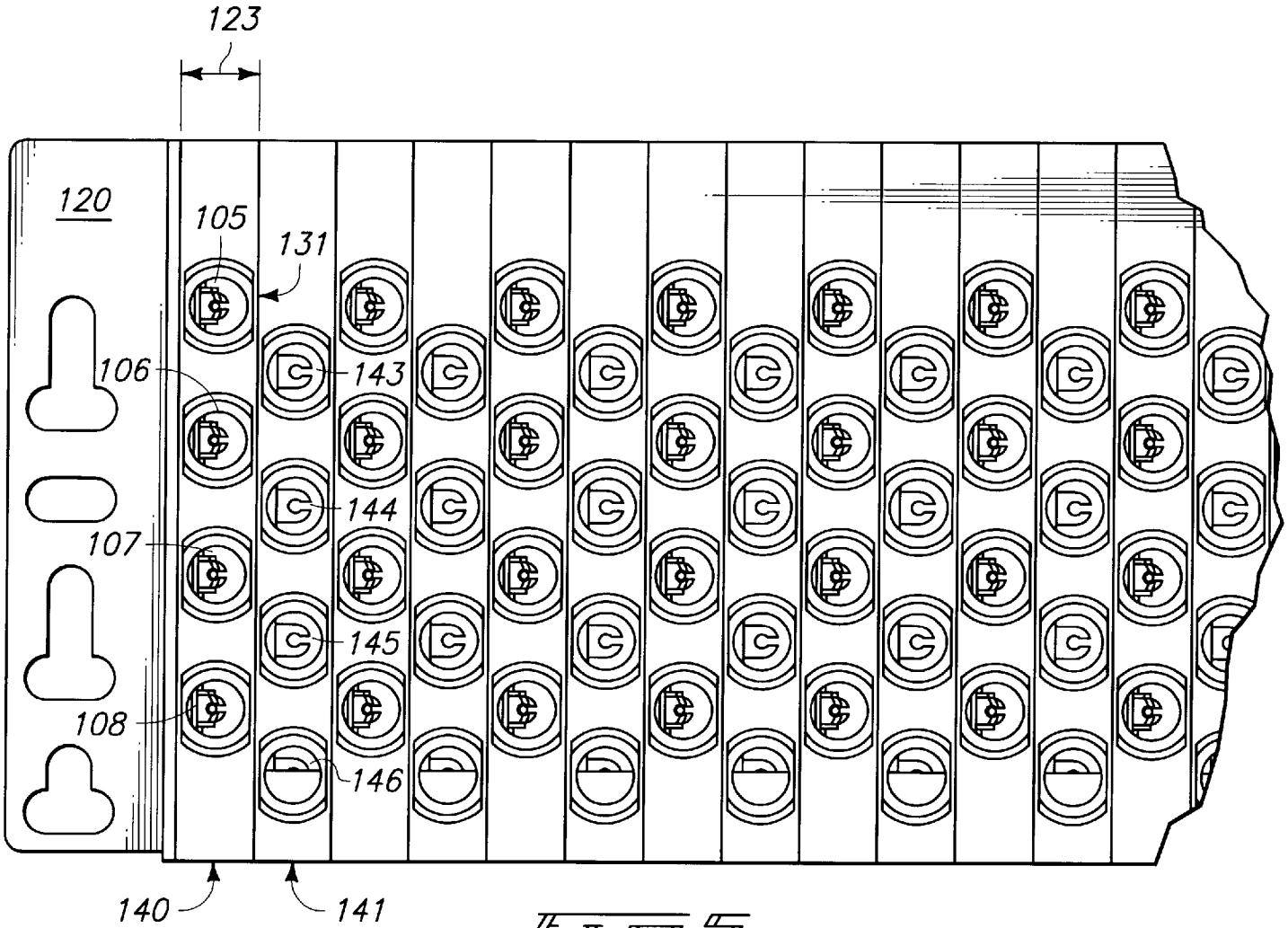
FIG. 5 is a partial elevation front view of the DSX-3 chassis illustrated in FIG. 1.

FIG. 4 is a side view of the chassis framework 101 shown in prior figures and illustrates a chassis system 100 contemplated by this invention. FIG. 4 illustrates front end 101*a* and rear end 101*b* of chassis framework 101, and the chassis framework 101 is a height 122 which is preferably approximately four inches. Mounted toward the rear end 101*b* of chassis framework 101 are first cable connector 112, second cable connector 113, third cable connector 114 and fourth cable connector 115, each with one of a plurality of coaxial cables 110 inserted therein FIG. 5 is a partial front elevation enlarged view of chassis framework 101 (shown in FIG. 4), illustrating mount bracket 120, odd module 140 and even module 141. The DSX-3 connectors shown in FIG. 5 are preferably mini-weco connectors, with first connector 105, second connector 106, third connector 107 and fourth connector 108 being on odd module 140. Vertically staggered from connectors on odd module 140 are the connectors within even module 141, illustrating first connector 143, second connector 144, third connector 145 and fourth connector 146 on even module 141. Flat side 131 to first connector 105 illustrates steps taken to reach higher density levels for the connectors and allows 48 modules to be placed within an industry standard twenty-three-inch distribution frame.

Figure 6:
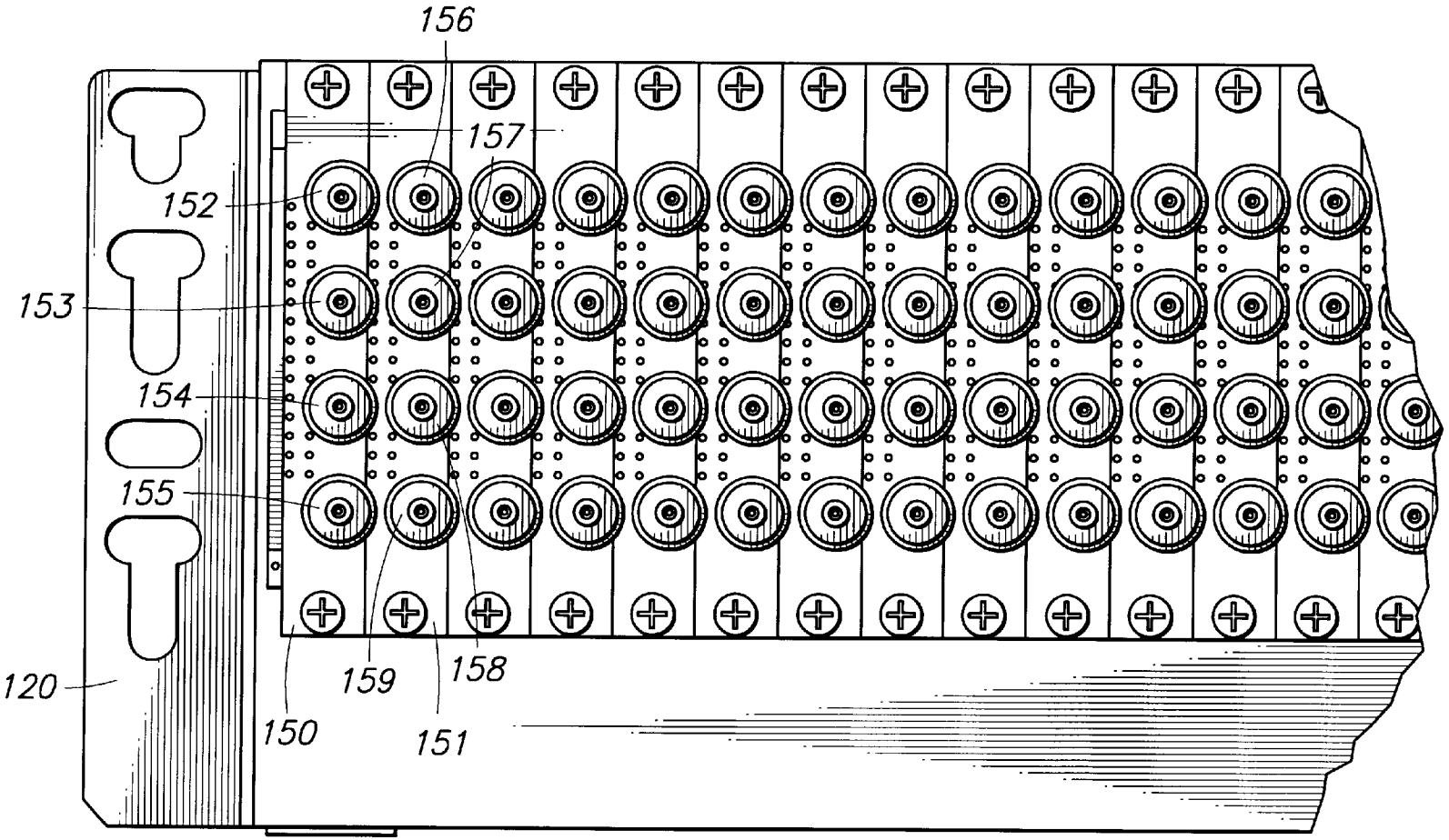
FIG. 6 is a partial rear elevation view of the DSX-3 chassis illustrated in FIG. 1.

FIG. 6 is a partial rear elevation view of chassis framework 101 (shown in FIG. 4), showing the corresponding rear cross connect portion of the chassis system. It will be noted that while the connectors on the front end 101b (shown in FIG. 3) of chassis framework 101 are vertically staggered or offset with respect to one another, the cable connectors illustrated on the rear end are vertically aligned on a module and horizontally aligned with respect to adjacent and other cable connectors on modules. First rear module 150 and second rear module 151 are shown, with first rear module 150 including first cable connector 152, second cable connector 153, third cable connector 154 and fourth cable connector 155. Second rear module 151 includes first cable connector 156 horizontally aligned with first cable connector 152 of first module 150. Also shown on second module 151 are second cable connector 157, third cable connector 158 and fourth cable connector 159.

FIG. 7 illustrates a typical coaxial cable 170 as it may be prepared for use in combination with embodiments of this invention. Coaxial cable 170 is shown with cable jacket 171, outer conductor 172, insulator 173 and center conductor 174. Preferably, the coaxial cable would be prepared such that center conductor 174 may protrude distance 178 which is preferably twelve one-hundredths of an inch, and coaxial insulator 173 will protrude from outer conductor 172 distance 177, which is preferably sixteen one-hundredths of an inch. Outer conductor 172 will be prepared to protrude from cable jacket 171 distance 176. The aforenamed distances are for a type 735 coaxial cable which is a 75-OHM coaxial cable. Embodiments of this invention contemplate cables of different sizes and configurations (such as the 734 or RG59 type or size coaxial cable), with no particular one being required to practice this invention.

In FIG. 7, the center conductor 174 is exposed such that electrical contact may be made with it, as is outer conductor 172, as the cable jacket 171 has been partially removed to more readily allow electrical contact with it.

FIG. 8 is an elevation view of coaxial cable 170 which has been prepared for insertion into an embodiment of a cable connector contemplated by this invention. FIG. 8 illustrates crimp contact 180 (which has been crimped, soldered or otherwise attached to cable center conductor 174), outer conductor sleeve 181, outer conductor 172 and cable jacket 171. Although crimp contact 180 may be utilized in embodiments to this invention, it is not necessary to practice the cable connector of this invention, although it is preferred. The crimp contact 180 is known in the industry for use with coaxial cables even when connectors are placed on the coaxial cable to improve the contact and matability of the cable center conductor 174.

FIG. 9 is section 9—9 from FIG. 8, and illustrates coaxial cable 170, cable jacket 171, outer conductor 172, outer conductor sleeve 181, crimp contact 180 and cable center conductor 174.

FIG. 10 is an exploded view of an embodiment of one cable connection system contemplated by this invention. Applicant believes this is the first cable connection system which does not require a connector to first be attached to the coaxial cable 170. All of the gripping or holding required is contained within the cable connection system in which the coaxial cable is inserted. The coaxial cable 170 must be prepared to be inserted into any cable connection system, including this one. The preparation for this one would require the exposure of cable center conductor 174, partial removal of insulator 173, partial removal of outer conductor 172 and partial removal of cable jacket 171. Not all of this preparation is required to practice this invention; however, it is preferred.

While no attachments or other devices need to be attached to the prepared coaxial cable 170, it is preferable to add crimp contact 180 as is commonplace and standard in the industry, and outer conductor sleeve 181 (which may also be a braid retainer), outer conductor 172 (typically, but not necessarily a braided conductor) becomes frayed and over multiple insertions and removals from a cable connection system may deteriorate and require additional preparation of the coaxial cable. It is preferred therefore to attach outer conductor sleeve 181 over braided outer conductor 172 in order to control the braid, prevent fraying and increase the wear life or number of insertions of the coaxial cable 170 into a cable connection system. Outer conductor sleeve 181 (which may be a sleeve like unit partially or wholly conductive) may be slid over the prepared braided outer conductor 172 and then crimped on or attached in any other way known in the industry.

FIG. 10 illustrates main body 204 and outer body 205, which includes mount legs 206 thereon. Center conductor 207 is inserted into and through dielectric insulator 208 within outer body 205. There is a collet 201 which is in four pieces, namely first part piece 201*a*, second collet piece 201*b*, third collet piece 201*c* and fourth collet piece 201*d*. Nut 203 inserts into ferrule 200 and may be axially driven or screwed into the internal threads 199 of ferrule 200. Main body aperture 211 in nut 203 receives main body 204 of the cable connector system.

Figures 11, 12, 13:
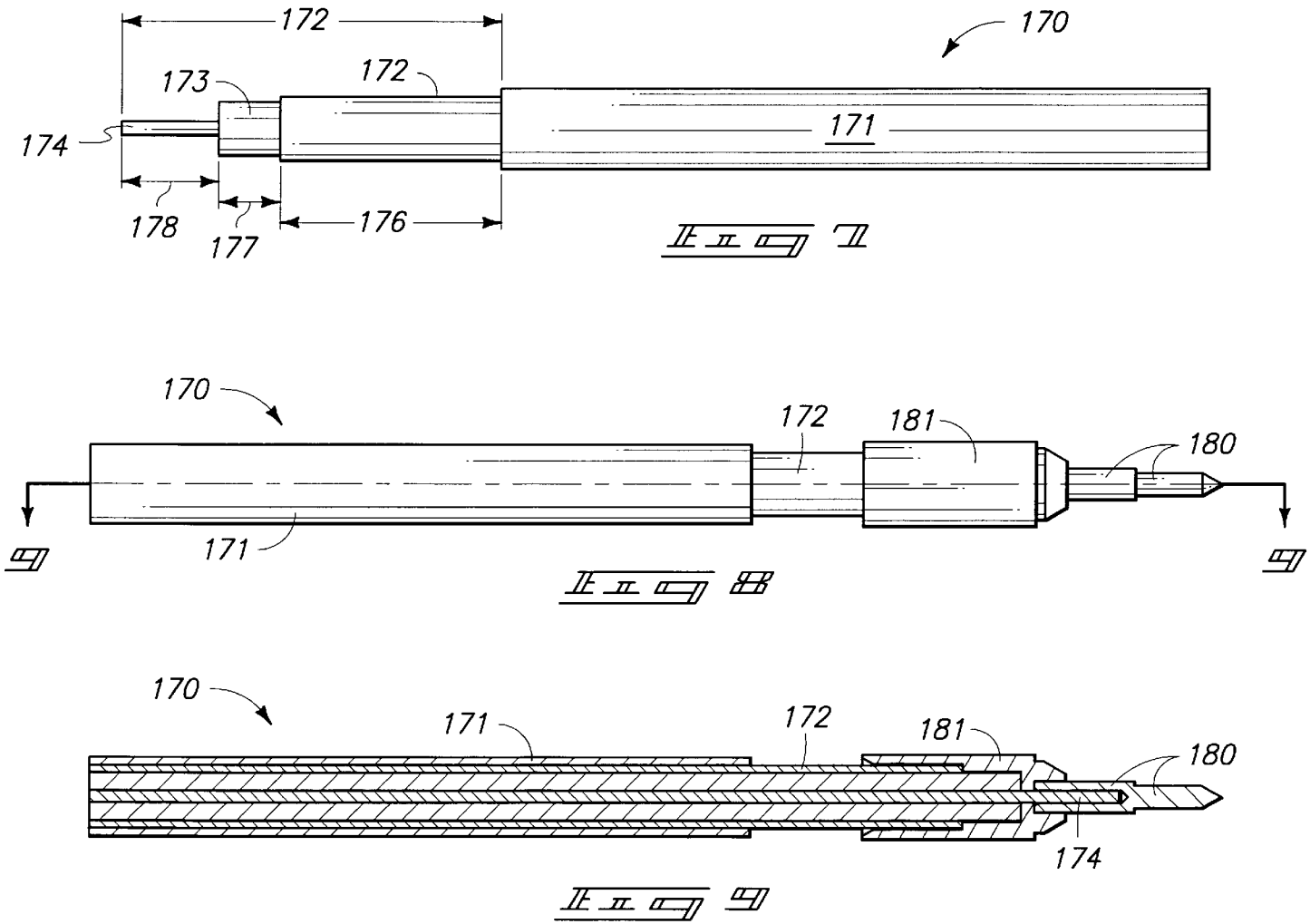
FIG. 11 is an elevation view of a coaxial cable partially inserted into an embodiment of a cable connection system contemplated by this invention.
FIG. 12 is section 12—12 from FIG. 11.
FIG. 13 is an elevation view of an embodiment of this invention wherein a coaxial cable is fully inserted into an embodiment of the cable connection system contemplated by this invention.
Figure 11:
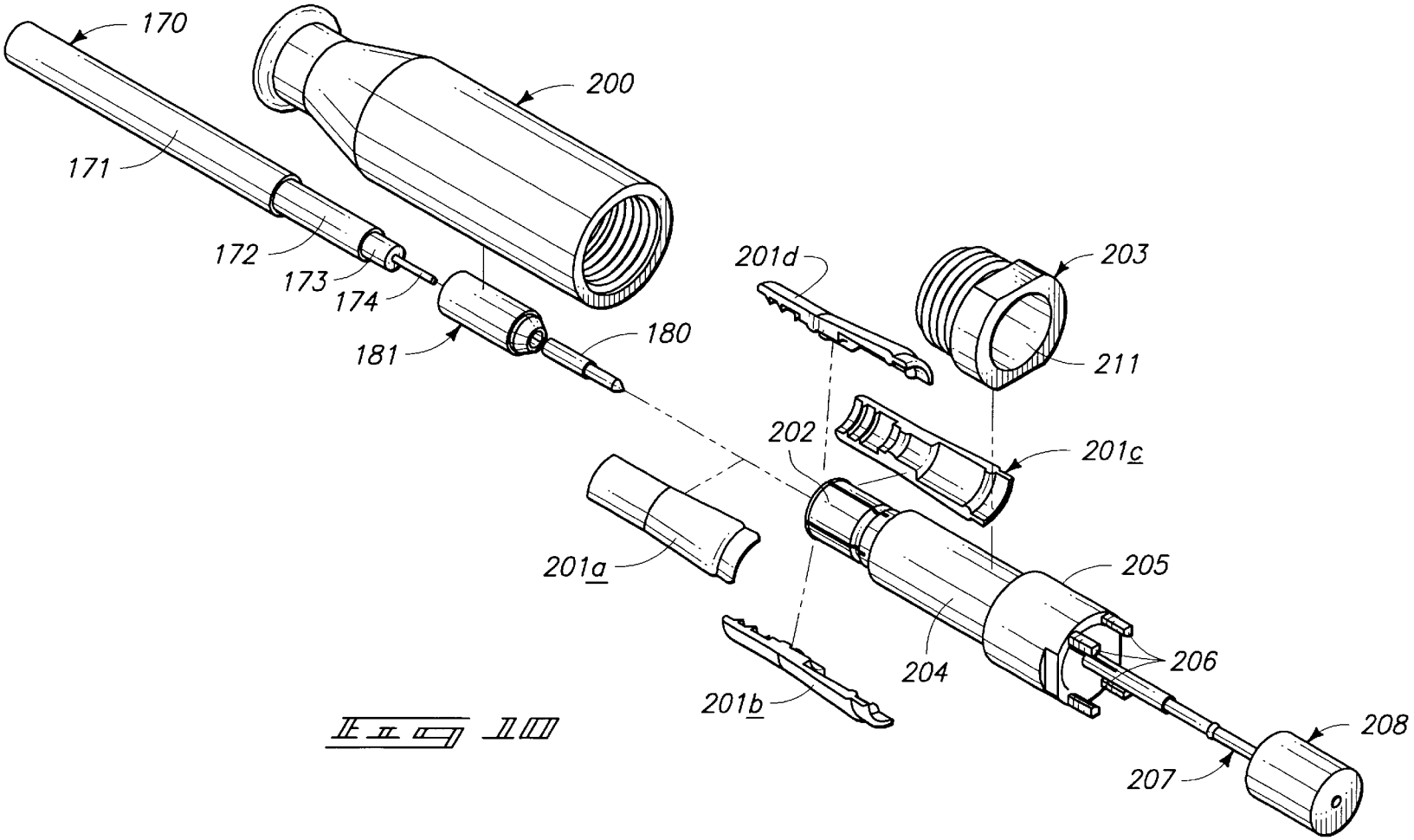
Figure 11:
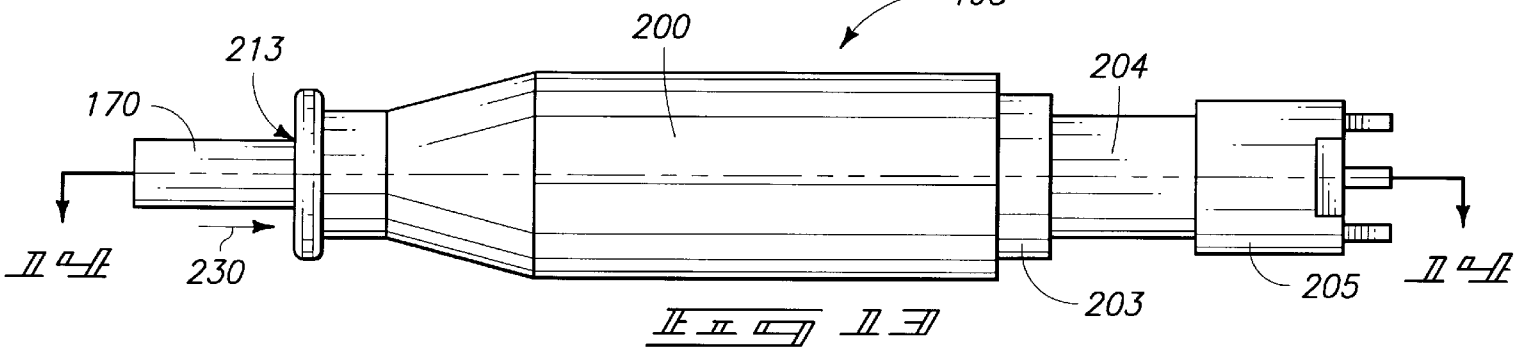
Figure 12:
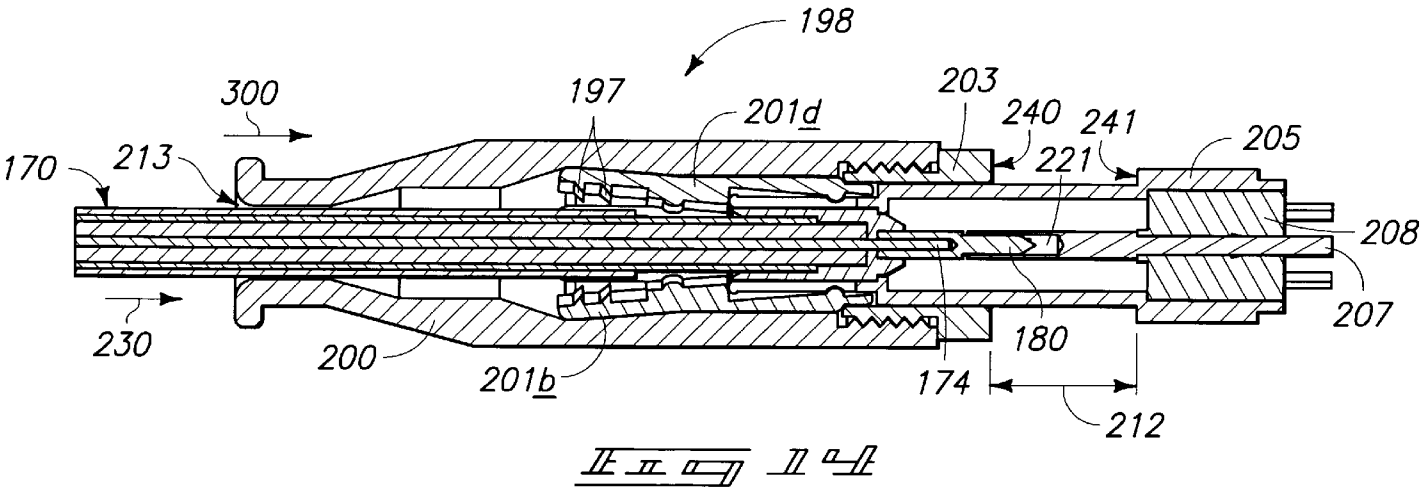

FIG. 11 is an elevation view of coaxial cable 170 partially inserted into the cable connection system through ferrule entrance 213 of ferrule 200. Nut 203, main body 204, outer body 205 and legs 206 are also shown in FIG. 11.

FIG. 12 is section 12—12 of FIG. 11 and more fully illustrates coaxial cable 170 partially inserted into the cable connection system 198. FIG. 12 illustrates coaxial cable 170, cable center conductor 174, coaxial insulator 173, outer conductor 172 inserted in ferrule entrance 213 of ferrule 200. Already attached to cable 170 are outer conductor sleeve 181 (which is dielectric) and crimp contact 180.

A section of second collet piece 201*b* and fourth collet piece 201*d* is shown. It will be noted when the coaxial cable 170 is inserted at this location, the fourth collet piece 201*d* has not yet crimped down on the coaxial cable. Instead, this occurs later in the insertion process when pinch ramps 214 within the cavity in ferrule 200 force collet pieces 201*b* and 201*d* toward each other and toward coaxial cable 170. The edges and grippers 197 on collet piece 201*b*, as well as other grippers on other collet pieces, will then secure and hold coaxial cable 170 within cable connection system 198.

Crimp contact 180 at this stage is located within entry section 202 of main body 204 of the cable connection system. Fourth collet piece 201*d* is inserted within the internal cavity of ferrule 200 and includes notch 220 which inserts into an inner axial detent in the outer wall of entry section 202. Although in the preferred embodiment, the collet 201 pivots to electrically connect/disconnect to, or engage and disengage, the braided outer conductor, about notch 220, it may be configured to pivot or move with respect to any one of a number of points, with no one in particular being required to practice this invention.

Fourth collet piece 201*d* pivots about this, and this not only allows collet piece to be crimped or pinched onto coaxial cable 170 but also to be pivotally moved upon removal so that coaxial cable 170 is released, as is shown in later figures.

FIG. 12 also illustrates outer body 205, mount legs 206, center conductor 207, dielectric insulator 208 and conductor recipient 221. FIG. 12 also illustrates distance 212 which is a distance that nut 203 must travel to contact the shoulder of outer body 205, as shown more fully in FIGS. 15 and 16.

FIG. 13 and FIG. 14 illustrate the cable connection system 198 of a position when coaxial cable 170 has been further inserted into the cable connection system 198 such that crimp contact 180 has been inserted into recipient contact 221, thereby making electrical connection of the central conductors 207 and 174.

FIG. 13 illustrates ferrule 200, nut 203, outer body 205, main body 204, ferrule entrance 213 and arrow 230 which indicates the coaxial cable 170 has been further inserted into the cable connection system 198, as compared to the distance of insertion illustrated in FIGS. 11 and 12.

FIG. 14 illustrates distance 212 which remains as shown in FIG. 12 as the securing movement has not yet been accomplished to securely attach the collet 201 to coaxial cable 170. Second collet piece 201*b* and fourth collet piece 201*d* are shown, and gripper 197 is not engaged in coaxial cable 170. FIG. 14 illustrates end 240 of nut 203, which will interact with and abut end 241 of outer body 205 once ferrule 200 is moved rearward to lock or fix coaxial cable 170 within cable connection system 198.

At this stage of insertion represented by FIGS. 13 and 14, the coaxial cable 170 has been fully inserted into cable connection system 198 such that electrical connection or operative electrical contact has been made between the center conductors. At this stage of insertion, the arrangement is near operational (the outer conductor is not yet grounded). However, it is desirable to have an increased or higher level of securement of coaxial cable 170 to and within cable connection system 198.

FIGS. 15 and 16 illustrate how ferrule 200 has been moved rearward according to arrow 300 to secure coaxial cable 170 within cable connection system 198. The collet 201 (as represented by second collet piece 201*b* and fourth collet piece 201*d*) has been forced inwardly to interact with and grip coaxial cable 170. Collet ramp 214 in the internal cavity of ferrule 200 forced the collet down to, around and on coaxial cable 170.

FIGS. 15 and 16 further illustrate center conductor 207, outer body 205, legs 206, nut 203 and the abutment area 245 between nut 203 and outer body 205. In this position, the coaxial cable 170 is securely attached to the cable connection system 198.

It should also be noted that the individual collet pieces, such as second collet piece 201*b* and fourth collet piece 201*d* have pivoted as reflected by the gap 247 between the collet piece and the entrance section 202 of main body 204. An exemplary point is item 253 in FIG. 16, which is a point or area which provides contact for grounding purposes. The other collet pieces would be similar. Contact 197 provides grounding contact with the braided outer conductor when the assembly is closed.

When it is desired to remove coaxial cable 170 from the cable connection system 198, the ferrule 200 is slid or pulled in the reverse direction of arrow 300, thereby pulling nut 203 away from outer body 205. The movement of ferrule 200 opposite arrow 300 allows collet 201 to be released via ramp 214 and move away from coaxial cable 170. The movement of ferrule 200 likewise forces collet to pivot at notch 220 from contact point 301.

The interaction of ferrule 200 at contact point 301 with collet 201 forces the grippers 197 on collet 201 to move away from and release coaxial cable 170.

Once ferrule 200 has been moved away and the collet 201 has released coaxial cable 170, then the coaxial cable 170 is released and may be further pulled out of cable connection system 198.

FIG. 17 is an end view of the cable connection system 198 (shown in FIG. 15), illustrating center conductor 207, legs 206, insulator or dielectric 208. Legs 206 may be utilized to mount the cable connection system 198 to a board or other structure for support while also aligning center conductor 207 with the desired equipment.

Figure 18:
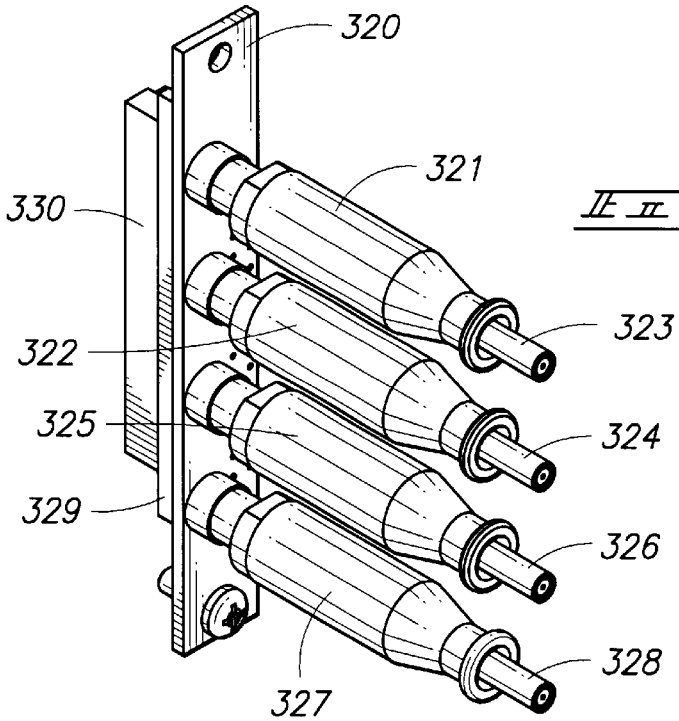
FIG. 18 is a perspective view of a rear module which utilizes an embodiment of a cable connection system contemplated by this invention.

FIG. 18 is a perspective view of a rear module arrangement which may utilize an embodiment of this invention. FIG. 18 illustrates mount bracket 320, first cable connector 321 with coaxial cable 323 inserted therein, second cable connector 322 with coaxial cable 324 inserted therein, third cable connector 325 with coaxial cable 326 inserted therein, and fourth cable connector 327 with coaxial cable 328 inserted therein. The cable connectors 321, 322, 325 and 327 are mounted on structure 320 with electrical connection being made with a printed circuit board 329. While numerous electrical connections may be made, the center conductor makes electrical contact with traces on the printed circuit board. DIN style connector 330 is shown attached to printed circuit board 329 for attachment to the modules at the front end of the chassis framework.

Figure 19:
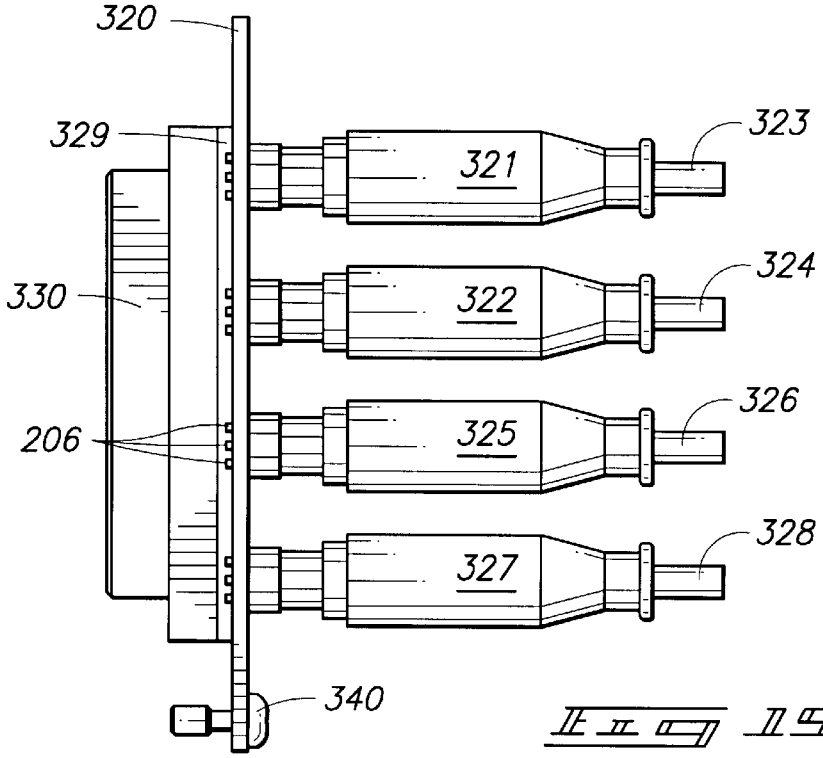
FIG. 19 is a side view of the module illustrated in FIG. 18.

FIG. 19 is a side view of the embodiment shown in FIG. 18, illustrating first cable connector 321, second cable connector 322, third cable connector 325, fourth cable connector 327 with coaxial cables 323, 324, 326 and 328 respectively inserted in the cable connectors. Mount bracket 320 is shown with an axially driven fastener 340 for attachment to chassis framework 101 (not shown in this figure). FIG. 19 further illustrates printed circuit board 329 with legs 206 attached and mounted to printed circuit board. DIN style connector 330 is shown mounted to printed circuit board 329 for further electrical connection to modules at the front end of chassis framework 101.

As will be appreciated by those of reasonable skill in the art, there are numerous embodiments to this invention, and variations of elements and components which may be used, all within the scope of this invention.

One embodiment of this invention for example is a cable connection system for receiving a digital signal cross-connect cable with an exposed center conductor section and an exposed outer conductor section, the cable connection system comprising: a connection system framework; a center conductor electrical contact mounted relative to the framework such that it is disposed to make electrical contact with the center conductor of the cable when the cable is inserted in the cable connection system; an outer conductor contact mounted relative to the framework such that it is disposed to make electrical contact with the outer conductor when the cable is inserted in the cable connection system; and a cable clamp mounted relative to the framework such that it is configured to receive and retain the cable.

Further embodiments of the above stated invention are further wherein: the center conductor electrical contact is a contact aperture with an internal cavity corresponding to the center conductor, the contact aperture being disposed to matingly receive the center conductor; the cable clamp is a collet; the clamp is also the outer conductor contact; the clamp is the sole retention means for retaining the cable; and/or the clamp is disposed to receive the cable, an outer conductor sleeve attached to the outer conductor, the outer conductor sleeve having a shoulder and the clamp having a stop corresponding to the shoulder such that the interaction of the stop and the shoulder retain the cable in the cable connection system.

In another embodiment, a cable connection system for receiving a digital signal cross-connect cable with an exposed center conductor section and an exposed outer conductor section is provided, the cable connection system comprising: a connection system framework; a center conductor electrical contact mounted relative to the framework such that it is disposed to make electrical contact with the center conductor of the cable when the cable is inserted in the cable connection system; an outer conductor contact mounted relative to the framework such that it is disposed to make electrical contact with the outer conductor when the cable is inserted in the cable connection system; and a cable retention means mounted relative to the framework such that it retains the cable received within the cable connection system.

Further embodiments of the above stated invention are further wherein: the center conductor electrical contact is a contact aperture with an internal cavity corresponding to the center conductor, the contact aperture being disposed to matingly receive the center conductor; the retention means includes a clamp within the cable connection system disposed to receive and retain the cable; the clamp is a collet; the clamp is also the outer conductor contact; the retention means of the cable connection system is the sole retention means for retaining the cable; and/or the retention means of the cable connection system includes a clamp disposed to receive the cable, an outer conductor sleeve attached to the outer conductor, the outer conductor sleeve having a shoulder and the clamp having a stop corresponding to the shoulder such that the interaction of the stop and the shoulder retain the cable in the cable connection system.

In another embodiment of the invention, a cable connection system is provided for receiving a digital signal cross-connect cable with an exposed center conductor section, an exposed outer conductor section, an exposed dielectric layer between the center conductor and the outer conductor, and a dielectric outer jacket, the cable connection system comprising: a ferrule with an internal surface defining an internal cavity, the ferrule including a first end and a second end, the first end of the internal cavity including a tapered section leading to a cable receiving aperture at the first end; a main body configured for insertion into the internal cavity of the ferrule, the main body including a center conductor aperture disposed to receive and make electrical contact with at least one of the center conductor of the cable and a crimp contact on the center conductor of the cable; a clamp pivotally positioned between the main body and the internal surface of the ferrule, the clamp being pivotal toward the cable to make contact with the cable and pivotal away from the cable, the clamp further making electrical contact with the outer conductor of the cable when the clamp is pivoted into contact with the cable; and wherein the movement of the tapered section of the internal cavity of the ferrule relative to the clamp moves the clamp into contact with the cable. Further embodiments of this are further wherein: the center conductor aperture is integral with the main body; and/or the intermediate sleeve connected to the outer conductor is a dielectric sleeve attached around the outer conductor.

In yet another embodiment, a high density telecommunications cabinet is provided, comprising: a chassis framework with a front end, a rear end, a first side, a second side, a top wall and a bottom wall; a plurality of DSX modules attached to the chassis framework, each of the DSX module including a cable connection system for receiving a digital signal cross-connect cable with an exposed center conductor section and an exposed outer conductor section, the cable connection system comprising: a center conductor electrical contact disposed to make electrical contact with the center conductor of the cable when the cable is inserted in the cable connection system; an outer conductor contact disposed to make electrical contact with the outer conductor when the cable is inserted in the cable connection system; and a retention means for retaining the cable received within the cable connection system. A further embodiment of this may include a configuration wherein the center conductor electrical contact is a contact aperture with an internal cavity corresponding to the center conductor, the contact aperture being disposed to matingly! receive the center conductor.

In a process embodiment of this invention, a process for inserting and connecting a digital signal cross-connect cable to a telecommunications component, comprising the following: providing a cable with a center conductor, an outer conductor, a dielectric layer between the center conductor and the outer conductor, and an outer dielectric jacket; creating an exposed center conductor section from which a portion of the outer conductor, a portion of the dielectric layer and a portion of the outer dielectric jacket have been removed; creating an exposed dielectric layer section from which the outer conductor and the outer dielectric jacket have been removed; creating an exposed outer conductor section from which the outer dielectric jacket has been removed; providing a cable connection system comprised of: a connection system framework; a center conductor electrical contact mounted relative to the framework such that it is disposed to make electrical contact with the center conductor of the cable when the cable is inserted in the cable connection system; an outer conductor contact mounted relative to the framework such that it is disposed to make electrical contact with the outer conductor when the cable is inserted in the cable connection system; and a cable clamp mounted relative to the framework such that it is configured to receive and retain the cable; and inserting the cable into the cable clamp such that electrical contact is made between the center conductor electrical contact and further such that electrical contact is made between the outer conductor and the outer conductor contact. Further embodiments of this process may include: attaching a crimp contact to the center conductor before inserting the cable into the telecommunications component; attaching an intermediate sleeve to the outer conductor before inserting the cable into the telecommunications component.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A cable connection system for receiving and releasing a digital signal cross-connect cable with an exposed center conductor section and an exposed outer conductor section, the cable connection system comprising:

a connection system framework;

a center conductor electrical contact mounted relative to the framework such that it is disposed to make electrical contact with the center conductor of the cable when the cable is inserted in the cable connection system;

an outer conductor contact mounted relative to the framework such that it is disposed to make electrical contact with the outer conductor when the cable is inserted in the cable connection system; and a cable clamp mounted relative to the framework such that it is configured to receive and retain the cable, and to release the cable.

2. A cable connection system as recited in claim 1, and further wherein the center conductor electrical contact is a contact aperture with an internal cavity corresponding to the center conductor, the contact aperture being disposed to matingly receive the center conductor.

3. A cable connection system as recited in claim 1, and further wherein the cable clamp is a collet.

4. A cable connection system, as recited in claim 1, and further wherein the cable clamp is also the outer conductor contact.

5. A cable connection system as recited in claim 1, and further wherein the clamp is the sole retention means for retaining the cable.

6. A cable connection system as recited in claim 1, and further wherein the clamp is disposed to receive the cable, an outer conductor sleeve attached to the outer conductor, the outer conductor sleeve having a shoulder and the clamp having a stop corresponding to the shoulder such that the interaction of the stop and the shoulder retain the cable in the cable connection system.

7. A cable connection system for receiving and releasing a digital signal cross-connect cable with an exposed center conductor section and an exposed outer conductor section, the cable connection system comprising:

a connection system framework;

a center conductor electrical contact mounted relative to the framework such that it is disposed to make electrical contact with the center conductor of the cable when the cable is inserted in the cable connection system;

an outer conductor contact mounted relative to the framework such that it is disposed to make electrical contact with the outer conductor when the cable is inserted in the cable connection system; and a cable retention means mounted relative to the framework such that it retains the cable received within the cable connection system and may correspondingly release the cable.

8. A cable connection system as recited in claim 7, and further wherein the center conductor electrical contact is a contact aperture with an internal cavity corresponding to the center conductor, the contact aperture being disposed to matingly receive the center conductor.

9. A cable connection system as recited in claim 7, and further wherein the retention means includes a clamp within the cable connection system disposed to receive and retain the cable.

10. A cable connection system as recited in claim 9, and further wherein the clamp is a collet.

11. A cable connection system as recited in claim 9, and further wherein the clamp is also the outer conductor contact.

12. A cable connection system as recited in claim 7, and further wherein the retention means of the cable connection system is the sole retention means for retaining the cable.

13. A cable connection system as recited in claim 7, and further wherein the retention means of the cable connection system includes a clamp disposed to receive the cable, an outer conductor sleeve attached to the outer conductor, the outer conductor sleeve having a shoulder and the clamp having a stop, corresponding to the shoulder such that the interaction of the stop and the shoulder retain the cable in the cable connection system.

14. A cable connection system for receiving a digital signal cross-connect cable with an exposed center conductor section, an exposed outer conductor section, an exposed dielectric layer between the center conductor and the outer conductor, and a dielectric outer jacket, the cable connection system comprising:

a ferrule with an internal surface defining an internal cavity, the ferrule including a first end and a second end, the first end of the internal cavity including a tapered section leading to a cable receiving aperture at the first end;

a main body configured for insertion into the internal cavity of the ferrule, the main body including a center conductor aperture disposed to receive and make electrical contact with at least one of the center conductor of the cable and a crimp contact on the center conductor of the cable;

a clamp pivotally positioned between the main body and the internal surface of the ferrule, the clamp being pivotal toward the cable to make contact with the cable and pivotal away from the cable, the clamp further making electrical contact with the outer conductor of the cable when the clamp is pivoted into contact with the cable; and wherein the movement of the tapered section of the internal cavity of the ferrule relative to the clamp moves the clamp into contact with the cable.

15. A cable connection system as recited in claim 14, and further wherein the center conductor aperture is integral with the main body.

16. A cable connection system as recited in claim 14, and further wherein the intermediate sleeve connected to the outer conductor is a dielectric sleeve attached around the outer conductor.

17. A high density telecommunications cabinet, comprising:

a chassis framework with a front end, a rear end, a first side, a second side, a top wall and a bottom wall;

a plurality of DSX modules attached to the chassis framework, each of the DSX module including a cable connection system for receiving a digital signal cross-connect cable with an exposed center conductor section and an exposed outer conductor section, the cable connection system comprising:

a center conductor electrical contact disposed to make electrical contact with the center conductor of the cable when the cable is inserted in the cable connection system;

an outer conductor contact disposed to make electrical contact with the outer conductor when the cable is inserted in the cable connection system; and a retention means for retaining the cable received within the cable connection system.

18. A high density telecommunications cabinet as recited in claim 17, and further wherein the center conductor electrical contact is a contact aperture with an internal cavity corresponding to the center conductor, the contact aperture being disposed to matingly receive the center conductor.

19. A process for inserting and connecting a digital signal cross-connect cable to a telecommunications component, comprising the following:

providing a cable with a center conductor, an outer conductor, a dielectric layer between the center conductor and the outer conductor, and an outer dielectric jacket;

creating an exposed center conductor section from which a portion of the outer conductor, a portion of the dielectric layer and a portion of the outer dielectric jacket have been removed;

creating an exposed dielectric layer section from which the outer conductor and the outer dielectric jacket have been removed;

creating an exposed outer conductor section from which the outer dielectric jacket has been removed;

providing a cable connection system comprised of: a connection system framework; a center conductor electrical contact mounted relative to the framework such that it is disposed to make electrical contact with the center conductor of the cable when the cable is inserted in the cable connection system; an outer conductor contact mounted relative to the framework such that it is disposed to make electrical contact with the outer conductor when the cable is inserted in the cable connection system; and a cable clamp mounted relative to the framework such that it is configured to receive, retain and release the cable; and inserting the cable into the cable clamp such that electrical contact is made between the center conductor electrical contact and further such that electrical contact is made between the outer conductor and the outer conductor contact.

20. A process for inserting and connecting a digital signal cross-connect cable to a telecommunications component as recited in claim 19, and further comprising attaching a crimp contact to the center conductor before inserting the cable into the telecommunications component.

21. A process for inserting and connecting a digital signal cross-connect cable to a telecommunications component as recited in claim 19, and further comprising attaching an intermediate sleeve to the outer conductor before inserting the cable into the telecommunications component.

* * * * *